United States Patent [19]

Hwang

[11] Patent Number: 5,046,619

[45] Date of Patent: Sep. 10, 1991

[54] MINI-PACKAGE STRUCTURE OF RUBBISH BAGS

[76] Inventor: Feng-Lin Hwang, No. 21, Pa Te Rd., Chi Tu District, Keelung City, Taiwan

[21] Appl. No.: 506,962

[22] Filed: Apr. 5, 1990

[51] Int. Cl.[5] ..... B65D 85/62

[52] U.S. Cl. ..... 206/554; 206/494; 206/233; 221/63

[58] Field of Search ..... 206/554, 494, 233, 390; 383/37; 221/26, 63

[56] References Cited

U.S. PATENT DOCUMENTS

| | | | |
|---|---|---|---|
| 3,172,563 | 3/1965 | Harwood | 206/494 |
| 3,172,564 | 3/1965 | Enloe et al. | 206/494 |
| 4,201,029 | 5/1980 | Leener et al. | 206/494 |
| 4,305,503 | 12/1981 | Membrino | 206/554 |
| 4,453,649 | 6/1984 | Origuchi | 221/26 |
| 4,805,800 | 2/1989 | Nocek et al. | 221/63 |
| 4,817,790 | 4/1989 | Porat et al. | 206/494 |
| 4,904,092 | 2/1990 | Campbell et al. | 383/37 |

FOREIGN PATENT DOCUMENTS

| | | | |
|---|---|---|---|
| 235744 | 1/1964 | Austria | 206/494 |
| 1312783 | 4/1973 | United Kingdom | 206/554 |

*Primary Examiner*—David T. Fidei

*Attorney, Agent, or Firm*—Browdy and Neimark

[57] ABSTRACT

A mini-package structure for rubbish bags, comprising two identical rubbish-bag-belts comprising a series of rubbish bags with each bag's opening end connected to the previous one's closed end and overlapped and offset so that the bags opening ends in one belt lie between the opening ends of the bags in the other belt. The two overlapped rubbish-bag-belts are then alternately folded back and forth in opposite directions along the opening ends of each bag in an accordion pleat until all the bags in both belts have been folded. The folded belts are then placed in a packing box which has a drawing hole through which a user can draw out a rubbish bag while at the same time a part of next rubbish bag unit is drawn out to facilitate its use.

1 Claim, 1 Drawing Sheet

7
9
8

2
1

5
3
4
6
1
2

MINI-PACKAGE STRUCTURE OF RUBBISH BAGS

FIELD OF THE INVENTION

This invention relates to a mini-package structure of rubbish bags, and in particular a structure wherein each time a user draws out a rubbish bag through the drawing hole of a packing box a part of the next rubbish bag is drawn out in readiness for use.

BACKGROUND OF THE INVENTION

As living standards have risen in recent years, the volume of rubbish has correspondingly increased. In households and office buildings large rubbish bags and cans are widely used to contain the rubbish until it is collected by garbage trucks. While individually convenient when in use, the rubbish bags are stored in difficult to access rolls or packets. Indeed, accessing a bag from such a roll or packet when needed in a vehicle or other small space can be troublesome.

OBJECT OF THE INVENTION

The primary object of the present invention is to make access to rubbish bags more convenient by providing a mini-package structure of rubbish bags, comprising a packing box for such bags which can be used anywhere easily by assuring that each time a user draws a rubbish bag through a drawing hole in the packing box, part of the next rubbish bag is drawn out in readiness for use.

SUMMARY OF THE INVENTION

A mini-package structure of rubbish bags which is characterized in the overlapping of two rubbish-bag-belts comprised of individual rubbish bags in series, each bag's opening end connected to the previous one's closed end, the opening end of each bag of one of the rubbish-bag-belt's is laid between the opening end of each bag on the other rubbish-bag-belt. The two overlapping rubbish-bag-belts are then alternately folded back and forth in opposite directions along the opening ends of each bag in an accordion pleat until all the bags of both belts have been folded. The folded and overlapped belts are then placed in a packing box having a drawing hole. A user may then draw out a rubbish bag therefrom for use at the same time draw out a part of the next bag in readiness for the user.

SPECIFIC DESCRIPTION

Figures 1, 2, 3:
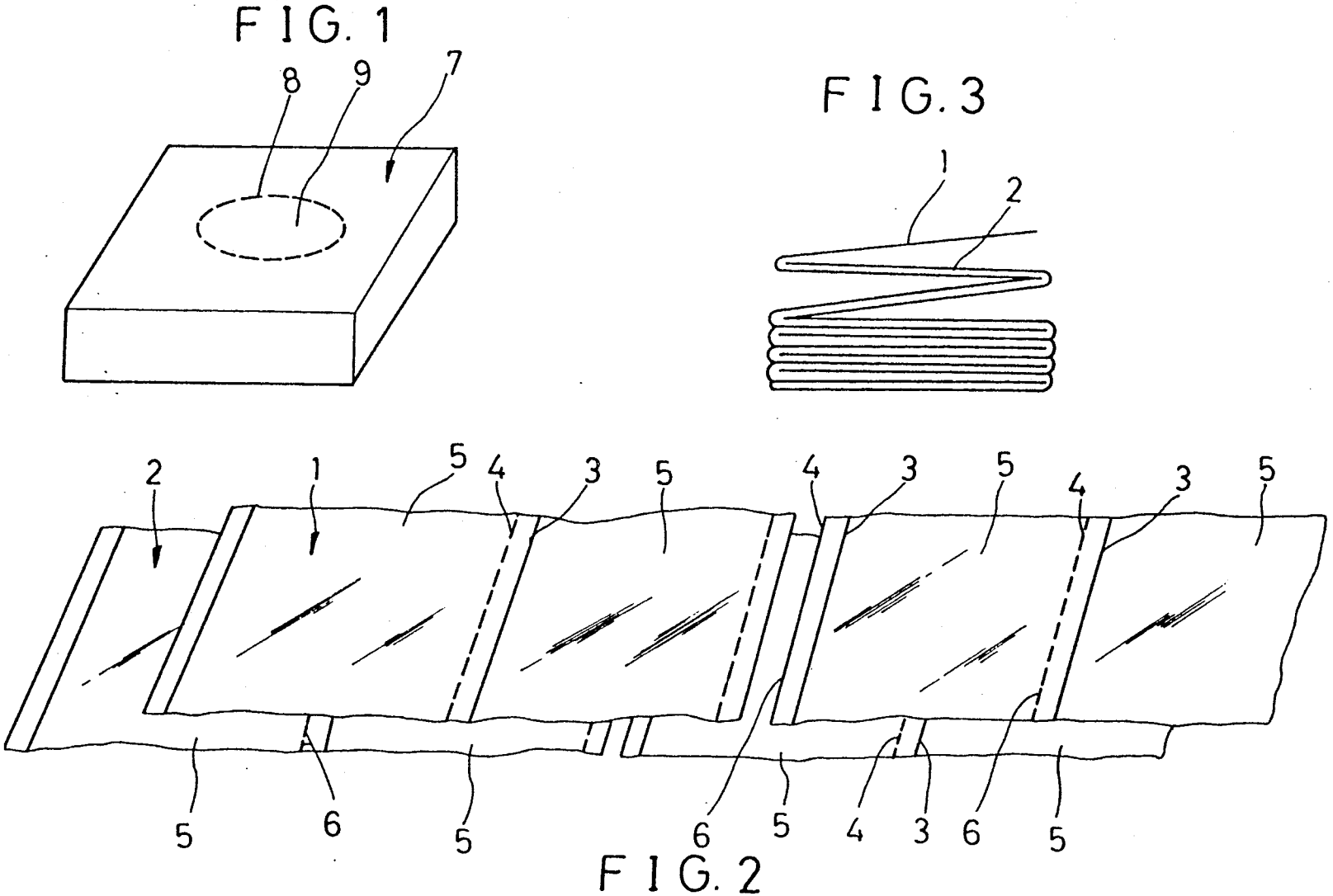
FIG. 1 is a perspective of the embodiment of packing box used with the rubbish-bag-belts of the invention.
FIG. 2 shows rubbish-bag-belts of the invention in a developed state.
FIG. 3 shows the folded state of the rubbish-bag-belts of the invention in the packing box of FIG. 1.

As FIG. 2 shows, this invention is characterized by two identical rubbish-bag-belts 1, 2 being offset to each other by approximately one half bag in each belt's longitudinal direction for folding as described below with an accordion pleat for packaging as shown in FIG. 3. Rubbish-bag-belt 1, 2 are made from two layers of a suitable paper, or any other material. The layers are sealed (not shown) at their longitudinal edges to create the sides of the bags in belts 1, 2. Each belt 1, 2, is provided with units of a rubbish bag 5 in series. The bags 5 are initially connected together when packaged and folded by separating line 4 which is perforated by small spaced slots or cut-out holes 6 in a manner providing for easy separation of the bags by a user from their respective belts. When a bag 5 is separated from its next adjoining bag 5 along line 4 and holes 6 an opening to the separated bag 5 is created along line 4. Each bag 5 has a closed end formed by connection mark 3, which can be made by gluing, or stitching the layers together.

FIG. 2 shows, rubbish-bag-belts 1, 2 prior to folding and packaging offset to each other by approximately one half bag in each belt's longitudinal direction. Prior to folding together belts 1, 2 are positioned so that the separating line 4 of each bag 5 of one of the rubbish-bag-belts is positioned between the separating lines of the other rubbish-bag-belt. Overlapped belts 1, 2 are then alternately folded back and forth in opposite directions along the separating lines of both belts in an accordion pleat, as shown in FIG. 3, until all the bags in both belts have been folded. FIG. 3 also shows a rubbish bag 5 contained between adjacent separating lines 4 on each of belts 1, 2. Then the folded rubbish-bag-belts are put into a packing box 7 which has a drawing hole 9 formed with spaced dots 8 on the cover. A user can draw out a rubbish bag 5 for use through drawing hole 9 and at the same time a part of the next bag will automatically be pulled out to facilitate its withdrawal.

I claim:

1. A mini-package structure of rubbish bags comprising:

a first rubbish-bag-belt:

said belt comprising a series of rubbish bags;

each of said rubbish bags having an opening end connected by a separating line to the closed end of the next adjacent rubbish bag;

a second rubbish-bag-belt identical to said first rubbish-bag-belt;

wherein said first rubbish-bag-belt and said second rubbish-bag-belt are overlapped and offset prior to folding and packaging so that the separating lines of said first rubbish-bag-belt lies between the separating lines of said second rubbish-bag-belt;

wherein the overlapped and offset rubbish-bag-belts are folded beginning from one end of said belts in one direction along the separating lines of said first rubbish-bag-belt and in the opposite direction along the separating lines of said second rubbish-bag-belt until all said rubbish bags in said belts have been folded flat;

a packing box with a drawing hole in which the folded rubbish-bag-belts are stored;

and wherein a user can draw out a rubbish bag while at the same time drawing out part of the next rubbish bag to facilitate its use.

* * * * *